United States Patent [19]

Bain, Jr. et al.

[11] 4,155,182

[45] May 22, 1979

[54] TEMPERATURE CONTROL FOR IRON

[75] Inventors: Benjamin H. Bain, Jr.; Wendell C. Walker, both of Alta Loma, Calif.

[73] Assignee: General Electric Company, Bridgeport, Conn.

[21] Appl. No.: 918,778

[22] Filed: Jun. 26, 1978

[51] Int. Cl.[2] ..... D06F 75/26

[52] U.S. Cl. ..... 38/77.7; 219/248

[58] Field of Search ..... 38/77.7; 126/227, 228, 126/230; 223/36; 219/245, 248, 250

[56] References Cited

U.S. PATENT DOCUMENTS

| | | | |
|---|---|---|---|
| 2,180,399 | 11/1939 | Clark | 219/245 |
| 2,593,812 | 4/1952 | Turner | 219/248 |
| 2,755,574 | 7/1956 | Herman | 38/77.7 |
| 3,111,780 | 11/1963 | Smith | 38/77.7 |
| 3,368,294 | 2/1968 | Martin | 38/77.7 |
| 3,541,306 | 11/1970 | Barnas et al. | 219/245 |

FOREIGN PATENT DOCUMENTS

| | | | |
|---|---|---|---|
| 770522 | 3/1957 | United Kingdom | 38/77.7 |

*Primary Examiner*—Louis Rimrodt
*Attorney, Agent, or Firm*—John F. Cullen; George R. Powers; Leonard J. Platt

[57] ABSTRACT

In a steam iron having a horizontal slot in the upper forward portion of the handle and a temperature control rod with its upper end disposed centrally of the slot, an improvement is provided in the temperature control assembly for operating the rod. A semi-circular crowned disc spring plate is provided with a projection and a depressed hollow recess in the crown surrounds the rod and has an upper annular bearing surface around the recess. The spring plate curves down from the bearing edge to the plate periphery and is fixed in the slot against withdrawal by a projection abutting the inner handle. A generally half-circular polypropylene dial plate support is provided with U-arms straddling the rod and with upper projections on each arm and in the bight of the U for locking the dial support in the handle slot. There is provided an integral rotatable thermoplastic polyester control lever with an external knob at one end and a recess at the other, the recess having opposite annular bearing surfaces and nesting in the spring plate recess. The lever has smooth facing surfaces abutting both the spring plate bearing surface and the underside of the dial plate, the entire combination being such that the elements are biased upwardly in a sandwich assembly by the disc spring plate to provide an easily assembled, long wearing and smooth operating three-piece control assembly.

4 Claims, 3 Drawing Figures

TEMPERATURE CONTROL FOR IRON

BACKGROUND OF THE INVENTION

1. Field of the Invention

The invention relates to an electric steam iron and, more particularly, to a temperature control assembly in the forward upper part of the iron handle for setting the iron temperature which assembly is a part plastic, easily assembled, long wearing, and smooth operating three-piece control assembly.

2. Description of the Prior Art

Electric flatirons, both dry and steam, employ a thermoplastic control for setting the iron temperature. The control may be disposed any place on the iron handle and a common procedure is to put it in the upper forward portion of the handle where it is easily accessible and seen. It generally consists of a dial plate giving the different temperatures and fabrics normally encountered and a movable member, such as a lever with a knob that is rotated by the user to line up with the appropriate indicia on the dial plate for the particular ironing operation, the components being disposed in a horizontal slot in the handle. Such arrangements have been in use for many years and a typical temperature control of this type is shown in expired U.S. Pat. No. 2,755,574 of common assignment. Generally, in the assembly of the iron, the components in the horizontal slot are assembled outside of the iron and then slid into position to lock over the control rod that sets the thermostat with the components snapping and locking in the handle slot. Other arrangements may have separate fastening means and covers to locate the control assembly in position. At any rate, a problem is presented on the assembly line because of the multiplicity of parts and also, when marketed, the constant moving by the user of the control rod induces wear and loose fitting. It is necessary to keep the parts snugly assembled, provide good bearing surfaces because of the rotating parts, and to provide a design that can easily be put together on the assembly line with subsequent smooth operation and long wear.

SUMMARY OF THE INVENTION

Briefly described, the invention is directed to a steam iron with a horizontal slot in the upper forward handle portion and a temperature control rod with its upper end disposed centrally of the slot and its lower end operatively connected to a thermostat. To this an improvement in the temperature control assembly for operating the control rod in the slot comprises a semicircular crowned disc spring plate having a lower projection and a depressed hollow recess in the crown surrounding the rod with an upper annular, flat bearing surface around the recess. The spring plate curves down from the bearing edge to the plate periphery and is fixed in the slot against withdrawal by the projection abutting an inner edge in the handle. A generally half-circular preferably polypropylene dial plate support is provided with U-arms straddling the rod and having upward projections at the end of each arm and in the bight of the U, the projections locking the dial support in the handle slot similar to the spring plate. A separate integral molded control lever preferably of thermoplastic polyester has an external control knob at one end and a recess at the other with opposite annular flat bearing surfaces at the recess with the recess resting in the spring plate recess. The control lever has smooth facing lower and upper suraces abutting the spring plate bearing surface and the underside of the dial plate. The combination is such that the elements are biased upwardly in a sandwich assembly by the disc spring plate to provide an extremely long wearing, smooth operating, simple three-piece control assembly that is easily and quickly assembled by an operator on the assembly line. Thus, the main object is to provide an iron with a simplified temperature control assembly in the forward handle portion.

DESCRIPTION OF THE PREFERRED EMBODIMENT

The invention will be described in connection with a typical electric flatiron having its control structure disposed in the upper forward portion of the iron handle although it is usable in other portions of the iron handle.

Figure 1:
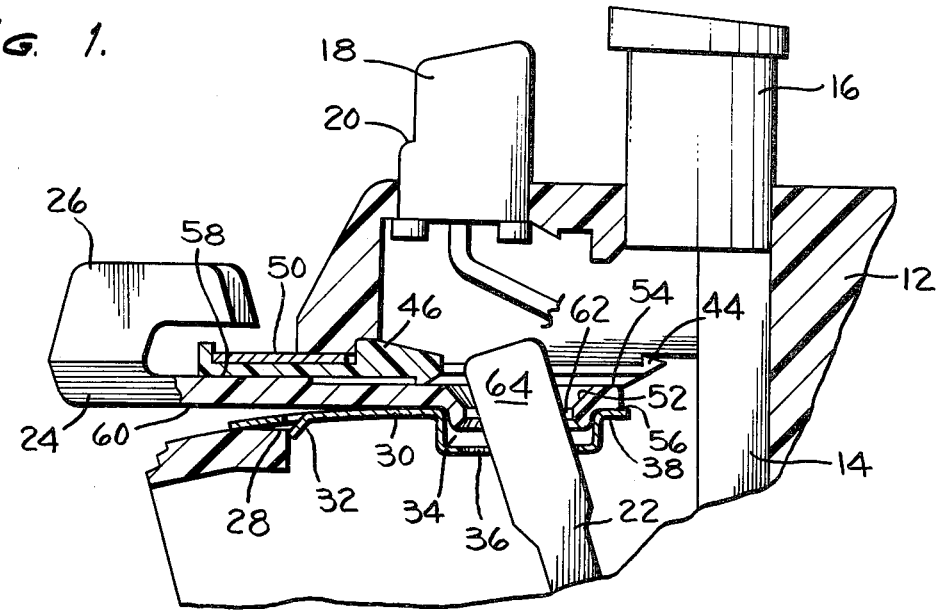
FIG. 1 is a partial sectional view through the upper forward portion of a typical flatiron showing the parts assembled.
Figure 2:
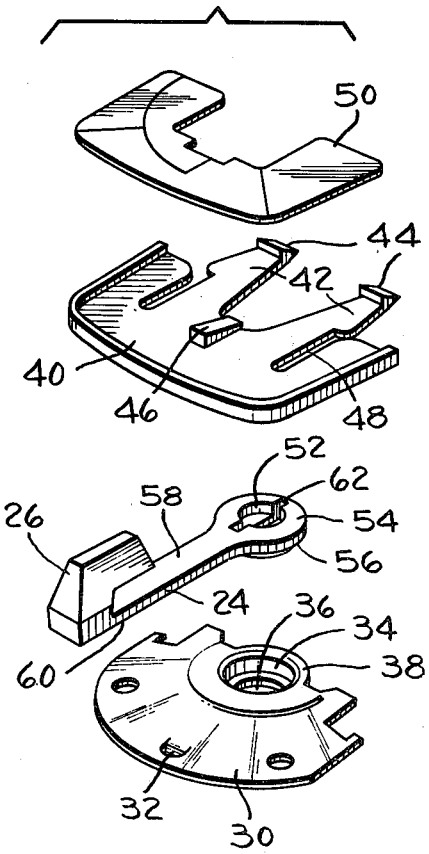
FIG. 2 is an exploded perspective view of the individual parts and, FIG. 3 is a partial plan view looking down on the top of FIG. 1.
Figure 3:
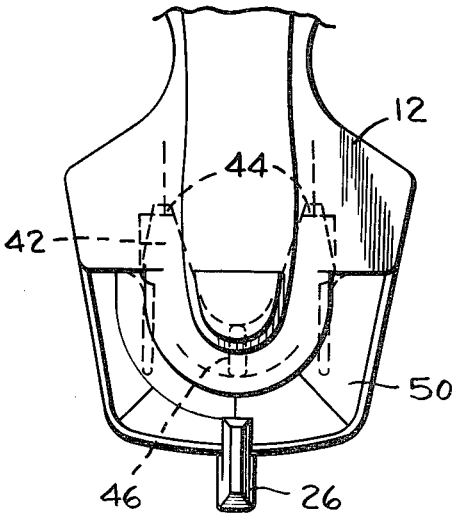

Referring to FIG. 1, there is shown an electric flatiron of the general type of said 2,755,574 patent, on which the instant invention improves, with a handle portion 12 in the upper forward part of the iron which handle portion is conventional plastic with a hollow portion 14 housing the internal mechanism. The iron may be equipped with a spray actuated by spray knob 16 and, separate steam control button 18, by connections not shown, directs steam to the soleplate when in up position as shown or the iron is operable dry when the steam button 18 is depressed and locked in the handle at notch 20 engaging under the overhanging housing as is well known.

The desired temperature of the iron is set by a temperature control rod 22 that extends downwardly where the lower end sets a thermostat and extends upwardly in the hollow handle with its upper end in hollow portion 14 in conventional manner. Rotation of rod 22 controls the iron temperature and is generally done by turning control lever 24 by an external knob 26 in a horizontal plane over an arc of about 180°. The components are assembled as in said 2,755,574 patent in a horizontal slot 28 cut into the front of the handle 12 to extend from outside into the hollow portion 14 with control rod 22 extending into the central portion of the slot as shown in FIG. 1.

To provide a simple temperature control assembly that may be easily put together on the assembly line as well as providing improved safety from electrical shock and from burns and discomfort, there is provided a semicircular disc spring plate 30 that is like an inverted plate in that it is crowned. It is preferably stamped out of spring steel so that it has a lower projection 32 at the forward end with a depressed hollow recess 34 in the crown portion. Thus, the spring plate is like an upside down dish that is slid into the horizontal slot to lock in position by the projection 32 engaging the inside of the handle housing fixing it in position in the slot against withdrawal. For guiding control rod 22, the recess has an opening 36 through which the upper end of the control rod extends substantially centrally of the slot and the hollow handle portion 14. As seen in FIG. 1, the spring plate curves down from the edge of a formed wide upper annular bearing surface 38 around the recess down to the plate periphery. Providing a base for the indicia to guide the user in setting the iron, a dial plate support 40 is provided and is generally half-circular in overall shape preferably of a molded polypropylene plastic because of its low cost and light weight. It is formed with U-arms 42 extending to straddle the control rod 22 as in FIG. 1. Locking the dial plate support 40 in the horizontal slot is accomplished by suitable molded upward projections 44 at the end of each arm and a single projection 46 located in the bight of the U, the projection locking against the inner portions of the housing 12. Resiliency is provided to the arms 42 by molding them as cantilevers with slots 48 allowing flexibility so the arms can lock against the housing 12.

While the temperature indicia may be provided directly on the upper surface of dial plate 40, an appropriately marked dial plate 50 is shown which nests in and rests on dial plate support 40 as shown in FIG. 1. This may be metallic, a decal, or may be omitted by printing disposed directly on the dial plate support.

For actually setting the temperature, an integral rotatable, and preferably thermoplastic polyester, control lever 24 is provided with a depressed recess 52 at the end opposite knob 26. Because of the plastic construction, recess 52 has opposite annular bearing surfaces 54 and 56 around the recess and the control lever recess 52 nests in disc spring plate recess 34. The plastic construction of control lever 24 and dial plate support 40 provides the control lever with smooth upper and lower facing surfaces 58 and 60 respectively abutting the underside of dial plate support 40 and annular bearing surface 38 of disc spring plate 30 as shown in FIG. 1 for substantially impervious to wear and unusually smooth operating bearing action.

Thus, the three elements of disc spring plate 30, control lever 24, and dial plate support 40 are placed in a sandwich assembly and biased upwardly at all times by the disc spring plate 30 as shown in FIG. 1. By making the disc spring plate of spring steel, there is provided a convenient snug arrangement whereby the parts are held together in a reliable take-up assembly by the squeezing action of the spring plate 30.

The temperature control lever 24 is connected to set the iron temperature by putting a suitable slot 62 in recess 52 of the control lever 24 and flattening the upper end of control rod 22 to form a tongue 64 cooperating with the slot 62 in a conventional manner.

Assembly is achieved by sliding disc spring plate 30 into position in slot 28 and over control rod 22 and locking it by the projections which fix it in the handle. The control lever 24 is next slid into position aligning slot 62 over tongue 64 and then rotated to one extreme or the other of it's 180° travel. Then dial plate support is slid in over the two components until the projections 44 and 46 are biased to lock in position in the handle whereupon the entire assembly is firmly fixed in position.

The simple three piece assembly has numerous advantages including improved safety from electrical shock by the use of the plastic parts to provide a second insulation level or double insulation between the user and any internal electrical potential. This is required by some safety agencies abroad and whether required or not, is an extra level of safety. It also provides improved thermal isolation from the hot temperature shaft 22 and eliminates burns and discomfort if the user comes in contact with the normal hot metal dial plate support or the metal portion of the conventional temperature control lever 24. Further, and importantly, the operational life of the particular plastic system disclosed is 10–50 times the life of the conventional metal system. Finally, the use of the plastics provides a much smoother feel to the operation with predictability for very fine adjustments and a convenient take-up biasing effect to hold the entire assembly in position by the use of the metallic disc spring plate 30.

While we have hereinbefore shown a preferred form of the invention, equivalent variations are possible in light of the above teaching. It is therefore to be understood that, within the scope of the appended claims, the invention may be practiced otherwise than as specifically described, and the claims are intended to cover such equivalent variations.

I claim:

1. In a steam iron with a horizontal slot in the upper forward handle and a temperature control rod with its upper end disposed centrally of said slot, an improvement in the temperature control assembly for operating said rod in said slot comprising, a semi-circular crowned disc spring plate with a projection and a depressed hollow recess in the crown surrounding said rod, an upper annular bearing surface around the recess, said spring plate curving down from the bearing edge to the plate periphery and fixed in the slot against withdrawal by said projection abutting the inner handle, a generally half-circular dial plate support with U-aarms straddling said rod and with upward projections on each arm end and in the bight of the U locking said dial support in the handle, and an integral rotatable control lever with an external knob at one end and a recess at the other with opposite annular bearing surfaces and nesting in said spring plate recess, said lever having smooth facing surfaces abutting the spring plate bearing surface and the underside of said dial plate, whereby said elements are biased upwardly in a sandwich assembly by said disc spring plate to provide an easily assembled, long wearing, smooth operating, three-piece control assembly.

2. Apparatus as described in claim 1 wherein the upper end of said control rod is a flat tongue and the recess at the other end of said control lever contains a slot engaging said tongue for rotating said rod.

3. Apparatus as described in claim 2 wherein at least said dial plate support and control lever are both molded plastic.

4. Apparatus as described in claim 3 wherein said dial plate support and control lever are polypropylene and thermoplastic polyester respectively.

* * * * *